United States Patent [19]

Lin et al.

[11] Patent Number: 4,619,056

[45] Date of Patent: Oct. 28, 1986

[54] INSOLE WITH RIBBED ARCH STRUCTURE

[75] Inventors: Mark Y. Lin, Taichung, China; James C. Autry, Dallas, Tex.

[73] Assignee: Autry Industries, Inc., Dallas, Tex.

[21] Appl. No.: 716,966

[22] Filed: Mar. 28, 1985

[51] Int. Cl.[4] ..... A43B 13/40; A43B 21/32

[52] U.S. Cl. ..... 36/43; 36/37; 36/91; 128/586; 128/595

[58] Field of Search ..... 36/43, 44, 71, 35 R, 36/37, 91, 114, 30 R, 80; 128/581, 586, 595, 614, 615

[56] References Cited

U.S. PATENT DOCUMENTS

| | | | |
|---|---|---|---|
| 1,456,843 | 5/1923 | Clark | 36/37 |
| 1,517,170 | 11/1924 | Rosenthal | 36/43 X |
| 2,146,888 | 2/1939 | Fisch | 36/44 X |
| 4,075,772 | 2/1978 | Sicurella | 36/43 |
| 4,372,058 | 2/1983 | Stubblefield | 36/114 X |
| 4,399,621 | 8/1983 | Dassler | 36/114 X |
| 4,435,910 | 3/1984 | Marc | 36/44 |
| 4,534,121 | 8/1985 | Autry | 36/43 |

*Primary Examiner*—James Kee Chi

*Attorney, Agent, or Firm*—Jerry W. Mills; Gregory M. Howison

[57] ABSTRACT

An insole (10) for disposal in a shoe adjacent the sole of the foot includes a cushioning layer (12) having one surface thereof for disposal adjacent the sole of the foot and having a profile around the perimeter thereof which generally conforms to the contour of the sole of the foot to better disperse forces thereabout. The cushioning layer (12) includes a heel portion (14), a mid portion (16) and a toe portion (18). A plurality of arcuate ridges (20) are disposed on the surface of mid portion (16) and are integrally formed therewith. Ridges (20) are disposed in spaced apart relationship on the surface of mid portion (16) and extend across the entire width of insole (10) to form arcs of concentric circles having their radial centers in the middle of the heel portion (14). Each of ridges (20) is triangular in shape with its apex located adjacent the arch of the foot. Ridges (20) are thus operative to create a raised portion (26) on the upper surface of insole (10) adjacent the arch of the foot. In an alternative embodiment, ridges are formed on the heel portion of cushioning layer (12) to provide support and cushioning for the heel of the foot.

7 Claims, 4 Drawing Figures

INSOLE WITH RIBBED ARCH STRUCTURE

TECHNICAL FIELD OF THE INVENTION

The present invention relates generally to insoles for insertion into a shoe, and more specifically, to the structure of the arch therefor.

BACKGROUND OF THE INVENTION

Insoles are well known and are designed to be inserted into a shoe for providing support for various surfaces of the foot and for cushioning the foot within the shoe. The support areas of an insole conform to the surface of the foot and, when disposed adjacent the sole of the foot, provide a shock dispersion effect. Shock to any one part of the foot produced by foot-to-ground contact during normal walking or exercise is then dispersed and distributed more evenly over the other parts of the foot. This reduces pain during such movement and also provides comfort when the foot remains stationary.

Heretofore developed insoles have, however, in some instances failed to provide the necessary support for certain surfaces of the foot, specifically the arch, which can cause discomfort if not supported during exercise. Arch supports in prior insoles have also not been completely satisfactory in ease or cost of manufacture. A need has thus arisen for an insole which improves upon the prior art in ease and cost of manufacture, and which provides support and cushioning at the arch of the foot where it is most needed.

SUMMARY OF THE INVENTION

The present invention described and disclosed herein comprises an insole for disposal in a shoe adjacent the sole of the foot. The insole includes a layer of cushioning material fabricated from a resilient material having one surface thereof for disposal adjacent the sole of the foot and having a profile around the its perimeter reminiscent of that of the foot. The cushioning layer has a heel portion for disposal adjacent the heel of the foot, a mid portion for disposal adjacent the arch of the foot and a toe portion for disposal adjacent the toes of the foot. A plurality of cushioning ridges are integrally formed on the surface of the cushioning layer opposite the foot supporting surface and are located in the mid portion of the cushioning layer. The ridges are disposed in spaced apart relationship and extend across the entire width of the insole. The ridges form an arc of concentric circles with the radial center in the middle of the heel portion. The ridges are dimensioned so that the height of the ridges from the surface of the cushioning layer gradually increases from the medial edge of the insole to a point adjacent the arch of the foot and gradually decreases therefrom to the lateral edge of the insole. The ridges are thus operative to create a raised portion on the upper surface of the insole for disposal adjacent the arch of the foot to provide support therefor. In the preferred embodiment, the cushioning layer with the ridges formed therein is fabricated of a resilient material and thus also provides cushioning for the sole of the foot.

In an alternative embodiment of the present invention, ridges are also formed on the heel portion of the cushioning layer to provide support and cushioning for the heel of the foot. The ridges are arranged in concentric circles emanating from a radial center in the middle of the heel portion. In this manner, the ridges proximate the heel provide shock absorption forces that are dispersed concentrically about the rotation point of the heel.

In both embodiments, the space between adjacent ridges is sufficiently wide to prevent contacting of the ridges when the cushioning layer is under compression.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
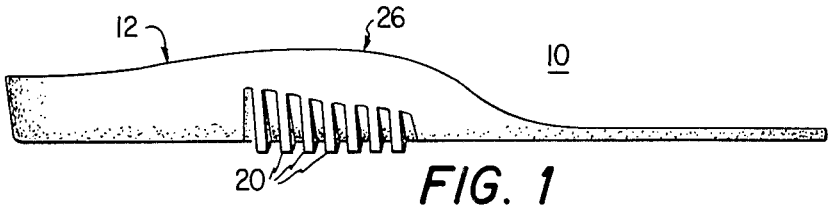
FIG. 1 illustrates a medial elevational view of the insole of the present invention.

Referring now to the Drawings wherein like reference numerals designate like or corresponding parts throughout, FIG. 1 is a medial elevational view of the insole of the present invention. The insole 10 is adapted to be inserted into a shoe for disposal adjacent the sole of the foot of the wearer to provide support and cushioning therefor.

Insole 10 comprises a cushioning layer 12 having one surface thereof for disposal adjacent the sole of the foot and having a profile around the its perimeter which generally conforms to the contour of the sole of the foot to better disperse forces thereabout.

Figure 2:
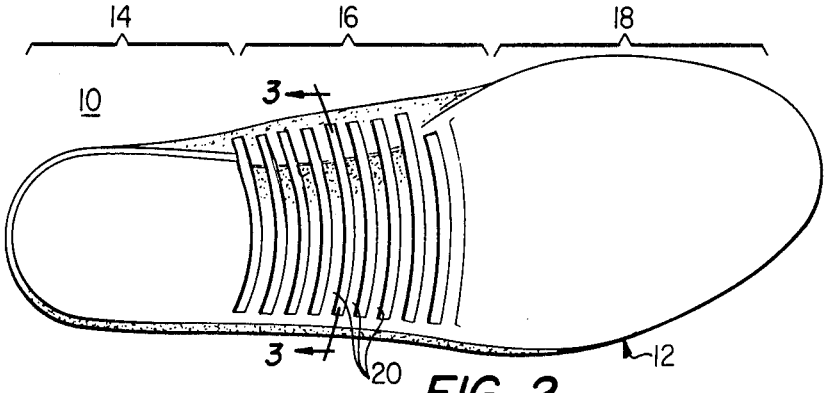
FIG. 2 is a bottom plan view of the insole of FIG. 1.

FIG. 2 is a bottom plan view of insole 10 showing the lower surface. As shown in FIG. 2, cushioning layer 12 may be viewed as having a heel portion 14, a mid portion 16 and a toe portion 18. A plurality of arcuate ridges 20 are disposed on the surface of mid portion 16 and are integrally formed therewith. Ridges 20 are disposed in spaced apart relationship on the surface of mid portion 16. The ridges extend across the entire width of insole 10 and form arcs of concentric circles having the radial center in the middle of heel portion 14.

Figure 3:
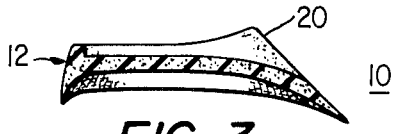
FIG. 3 is a cross-sectional view taken along lines 3—3 of FIG. 2 in the direction of the arrows.

As best seen in FIG. 3, each of ridges 20 is substantially triangular in shape. The apex of each of ridges 20 is located adjacent the arch of the foot. Ridges 20 are thus operable to create a raised portion 26 (FIG. 1) on the upper surface of insole 10 for disposal adjacent the arch of the foot and to provide enhanced support for the foot in the region of the arch. The ridges and insole 10 are integrally molded of a highly resilient material to provide the necessary cushioning for the wearer's foot and in the preferred embodiment are formed from polyurethane.

With further reference to FIG. 2 and as described above, the ridges are substantially parallel to one another and are dimensioned such that a space is formed therebetween. In practice, when the insole is inserted into a shoe, the ridges will absorb weight from the foot of the wearer. This weight will cause the ridges to expand laterally. It is essential therefore that the spaces between adjacent ridges be sufficiently wide to allow for this lateral expansion to guard against any deterioration of the cushioning effect. Were the sides of adjacent ridges permitted to touch during lateral expansion, the ridges would be forced into compression, thus undesirably reducing the cushioning effect. The spaces between adjacent ridges are thus preferably dimensioned so that any lateral expansion is confined to the spaces. In the preferred embodiment, the width of the space between ridges 20 is approximately equal to the width of the ridges.

Figure 4:
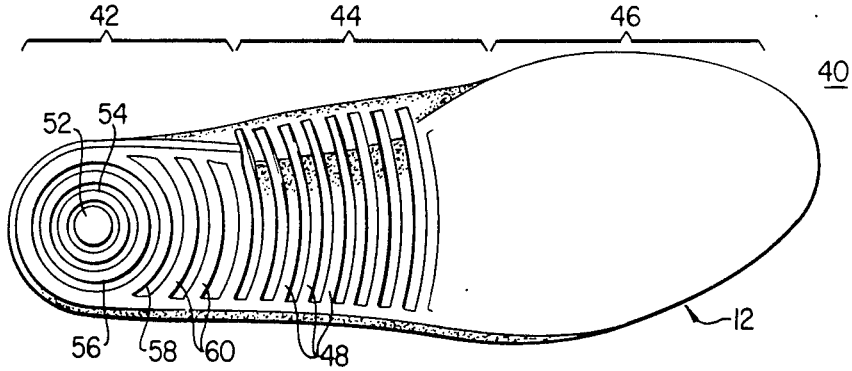
FIG. 4 is a bottom plan view of an alternative embodiment of the insole of FIG. 1.

Referring now to FIG. 4, there is illustrated a bottom plan view of an insole 40, that is an alternative embodiment of insole 10 of FIG. 1. Insole 40 comprises a heel portion 42, a mid portion 44 and a toe portion 46. Heel portion 42 and mid portion 44 have a plurality of ridges integral therewith. Ridges 48 formed on mid portion 44 are substantially identical to ridges 20 described above with respect to insole 10. Ridges 50 formed on heel portion 42 are formed from concentric circles emanating from a radial center on heel portion 42. A radial disc 52 having a cylindrical shape is disposed at the radial center of the concentric circles proximate the middle of heel portion 42.

Disposed radially outward from disc 52 is a first annular ridge 54. A second annular ridge 56 is disposed concentrically about disc 52 and first annular ridge 54 and a third annular ridge 58 is disposed concentrically about disc 52 and first and second annular ridges 54 and 56. The radial centers of disc 52 and annular ridges 54, 56 and 58 are located in the middle of the heel and are common to each other. Third annular ridge 58 forms the rearmost perimeter of heel portion 42. A plurality of arcuate ridges 60 are disposed on the surface of heel portion 42 forward of annular ridge 58 and extend therefrom to mid portion 44. Each of the ridges 60 comprises the arc of a circle having the radial center at the center of the disc 52 on heel portion 42. In this manner, disc 52, annular ridges 54, 56 and 58 and arcuate ridges 60 form the bottom surface of heel portion 42 to provide support for the heel of the foot. The height of each of the ridges and of the disc from the surface of the cushioning layer are substantially equal to provide maximum cushioning.

Disc 52 and annular and arcuate ridges 54, 56, 58 and 60 are preferably formed of resilient material to provide cushioning for the foot as described above with respect to insole 10. In addition, the disc and annular and arcuate ridges are dimensioned such that a space is formed therebetween dimensioned to accommodate the lateral expansion of the disc and ridges as weight is applied from the heel of the foot as described above with respect to insole 10. In the preferred embodiment, the width of the space between disc 52, the annular ridges 54, 56 and 58 and the arcuate ridges 60 is approximately equal to the width of the ridges.

By arranging the ridges as concentric circles, hydraulic cushioning forces can be directed along the line of motion of the heel of the foot, i.e., outward from the center. Because the heel is ball shaped, it essentially rotates about the center thereof with the toes providing support therefor. This lateral rotation or forward and backward rotation of the heel is compensated for by the concentric circle structure. For example, if the heel rotates toward the medial side of the foot, compressive forces resulting from compression of the annular ridges 54, 56 and 58 will be equal to the compressive forces that the foot incurs during rotation to the lateral side of the foot. Compressive forces are thus equally distributed about the heel of the foot in all directions of rotation of the heel.

In summary there has been provided a shoe insole that is fabricated from a resilient material such as polyurethane that has a plurality of ridges disposed on the undersurface thereof. The ridges are disposed proximate the mid portion of the insole and are dimensioned to provide a raised portion proximate the arch of the foot to provide support therefor.

In the alternative embodiment, ridges are also disposed on the heel portion of the insole to provide support and cushioning for the heel of the foot of the wearer. The ridges are arranged along the circumferences of concentric circles having the radial center thereof disposed in the middle of the heel portion of the insole. The ridges thus provide shock absorption forces that are dispersed concentrically about the rotation point of the heel.

Although the preferred embodiment has been described in detail, it should be understood that various changes, substitutions and alterations can be made therein without departing from the spirit and scope of the invention as defined by the appended claims.

What is claimed is:

1. An insole for insertion into a shoe to provide support for the foot, comprising:

a layer of cushioning material fabricated from a resilient material and having an upper surface for being disposed adjacent the sole of the foot and generally having a profile around the perimeter thereof similar to that of the foot, a lower surface of said cushioning layer opposed to said upper surface, said cushioning layer having:

a heel portion for disposal adjacent the heel of the foot;

a mid portion for disposal adjacent the arch of the foot; and a toe portion for disposal adjacent the toes of the foot;

said mid portion having a plurality of substantially triangular ridges formed on said lower surface, said ridges disposed in spaced-apart relationship and extending from the medial side of said insole substantially across to the lateral side of said insole, said ridges forming arcs of concentric circles having a common radial center and dimensioned such that the apex of said triangular ridges is located proximate the arch of the foot, said ridges operative to create a raised portion on said upper surface at said mid portion to provide support for the arch of the foot.

2. The insole of claim 1 wherein said center of said concentric circles is located in the middle of said heel portion.

3. The insole of claim 1 wherein said ridges are spaced apart a distance at least equal to the width of the ridges such that contact between the sides of adjacent ridges is prevented during compression and lateral expansion of said ridges.

4. The insole of claim 1 wherein said cushioning layer is fabricated of polyurethane.

5. The insole of claim 1 wherein said cushioning layer further comprises ridges formed on said lower surface on the heel portion thereof, said ridges arranged in concentric circles emanating from a radial center in the center of said heel portion.

6. The insole of claim 5 further comprising a cylindrically shaped disc formed at the radial center of said ridges and having a height from said lower surface of said cushioning layer equal to that of said ridges on said heel portion, such that said cylindrically shaped disc provides maximum cushioning for the center of the heel of the foot.

7. An insole for disposal between the sole of the foot and a sole of a shoe, comprising:

a layer of cushioning material for absorbing the shock between the foot and the shoe and having an upper surface for being disposed adjacent the sole of the foot and a lower surface for being disposed adjacent the sole of the shoe and generally having a profile around the perimeter thereof similar to that of the foot, said cushioning layer having a heel portion for disposal adjacent the heel of the foot, a mid portion for disposal adjacent the arch of the foot, and a toe portion for disposal adjacent the toes of the foot;

a cylindrically shaped disc formed on said lower surface of said cushioning layer adjacent the center of said heel portion for providing cushioning to the central portion of the heel to the foot;

a plurality of annular ridges formed in said lower surface of the heel portion adjacent the radial center thereof coinciding with the center of said heel portion and said cylindrical shaped disc; and a plurality of arcuate ridges formed in said lower surface at said heel portion forward of said annular ridges and extending to said mid portion, said arcuate ridges forming a plurality of arcs of concentric circles with progressing radii centered in the middle of said heel portion;

a plurality of arcuate ridges formed in said mid portion, said arcuate ridges substantially triangular in lateral cross-section and forming a plurality of arcs of concentric circles with progressing radii centered in the middle of said heel portion and dimensioned so that the apex of each of said ridges is located proximate the arch of the foot, said annular ridges, said arcuate ridges of said heel portion and said arcuate ridges of said mid portion having bottom surfaces for disposal adjacent the sole of the shoe;

each said triangular ridge of said mid portion having an apex for disposal beneath the arch of the foot, said ridges of said mid portion operative to create a raised portion on said upper surface at said mid portion to provide support for the arch of the foot; and said cylindrical disc, said annular ridges, and said arcuate ridges having a space between adjacent sides thereof at least equal to the width thereof such that compression of said ridges and said cylindrical disc does not result in contact between the sides thereof.

* * * * *